US010081203B2

(12) United States Patent
Oguchi

(10) Patent No.: US 10,081,203 B2
(45) Date of Patent: Sep. 25, 2018

(54) INKJET PRINTING APPARATUS AND METHOD OF CONTROLLING THE SAME

(71) Applicant: BROTHER KOGYO KABUSHIKI KAISHA, Nagoya-shi, Aichi-ken (JP)

(72) Inventor: Tomoya Oguchi, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/439,266

(22) Filed: Feb. 22, 2017

(65) Prior Publication Data

US 2017/0246890 A1 Aug. 31, 2017

(30) Foreign Application Priority Data

Feb. 29, 2016 (JP) ..... 2016-037684

(51) Int. Cl.
*B41J 2/165* (2006.01)
*B41J 25/00* (2006.01)

(52) U.S. Cl.
CPC ..... *B41J 25/001* (2013.01); *B41J 2/16505* (2013.01)

(58) Field of Classification Search
None
See application file for complete search history.

(56) References Cited

U.S. PATENT DOCUMENTS

2007/0090586 A1* 4/2007 Ohnishi ..... G03G 15/607 271/9.01
2014/0035983 A1* 2/2014 Kyotani ..... B41J 2/07 347/14
2016/0224876 A1* 8/2016 Horade ..... G06K 15/4025

FOREIGN PATENT DOCUMENTS

JP 2000-141822 A 5/2000
JP 2002-73300 A 3/2002
JP 2016-140978 A 8/2016

* cited by examiner

*Primary Examiner* — Erica Lin
(74) *Attorney, Agent, or Firm* — Merchant & Gould P.C.

(57) ABSTRACT

A controller of an inkjet printing apparatus is configured to receive first data, which an information processing apparatus transmits in response to receipt of a print instruction. The first data includes an instruction to move the cap from a covering position to a spaced position. Upon receipt of the first data, the controller determines a location of the cap. Then, upon determination that the cap is located at the spaced position, the controller determines the state of the driving force transmission assembly. The controller switches the state to the first state by moving the carriage to the non-recordation area in response to determination that the state is not the first state. Then, the controller receives second data, which includes image recordation condition, from the information processing apparatus, in response to determination that the state is the first state or after switching of the state to the first state is started.

12 Claims, 11 Drawing Sheets

INKJET PRINTING APPARATUS AND METHOD OF CONTROLLING THE SAME

CROSS-REFERENCE TO RELATED APPLICATIONS

This application claims priority under 35 U.S.C. § 119 from Japanese Patent Application No. 2016-037684 filed on Feb. 29, 2016. The entire subject matter of the application is incorporated herein by reference.

BACKGROUND

Technical Field

The present disclosures relate to an inkjet printing apparatus configured to record images in accordance with an inkjet printing method, and a method of controlling such an inkjet printing apparatus.

Related Art

Conventionally, there is known a printing system having an information processing apparatus and a printing apparatus, in which the information processing apparatus transmits first data in response to receipt of an instruction to print an image, and thereafter transmits second data based on information to be printed. Typically, the printing apparatus in such a system executes a preparation operation in response to receipt of the first data. The preparation operation typically includes a cap releasing operation. The cap releasing operation is an operation to move a cap configured to cover an inkjet head from a covering position to cover the inkjet head to a spaced position at which the cap is spaced from the inkjet head.

There is also known a printing apparatus which is configured such that a state where the cap is spaced from the inkjet head is maintained for a certain period after completion of image printing (i.e., the printer waits for a capping operation to move the cap/inkjet head to a position where the cap covers the inkjet head).

SUMMARY

There is also known an inkjet printing apparatus which is configured such that a plurality of feed rollers thereof are driven with a single motor, and for this purpose, driving force transmission paths from the motor to respective feed rollers are switched. In such an inkjet printing apparatus, the driving paths should be appropriately switched in order to execute a printing operation.

According the inkjet printing apparatus configured to wait for the capping operation after completion of a printing operation, if the first data is received during a waiting period, it is not necessary to execute the cap releasing operation. According to the inkjet printing apparatus configured to switch the diving force transmission paths as mentioned above, however, it is necessary to switch the driving force transmission paths in order to start printing. In such a printing apparatus, therefore, a certain time period from receipt of a user instruction to start printing to execution of the printing operation is required.

BRIEF DESCRIPTION OF THE ACCOMPANYING DRAWINGS

Figure 1:
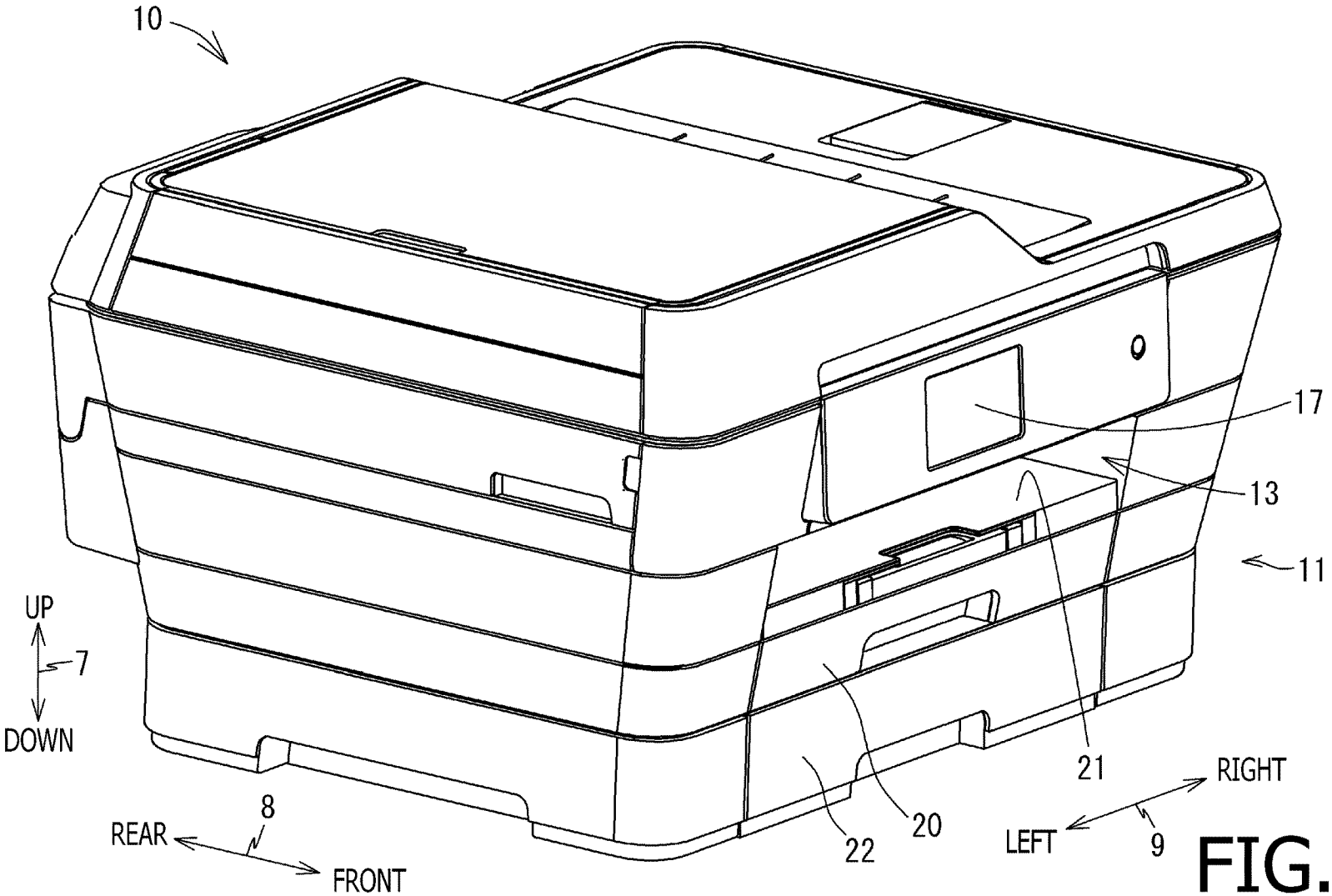
FIG. 1 is a perspective view of an MFP (multi-function peripheral) according to an illustrative embodiment of the disclosures.
Figure 5:
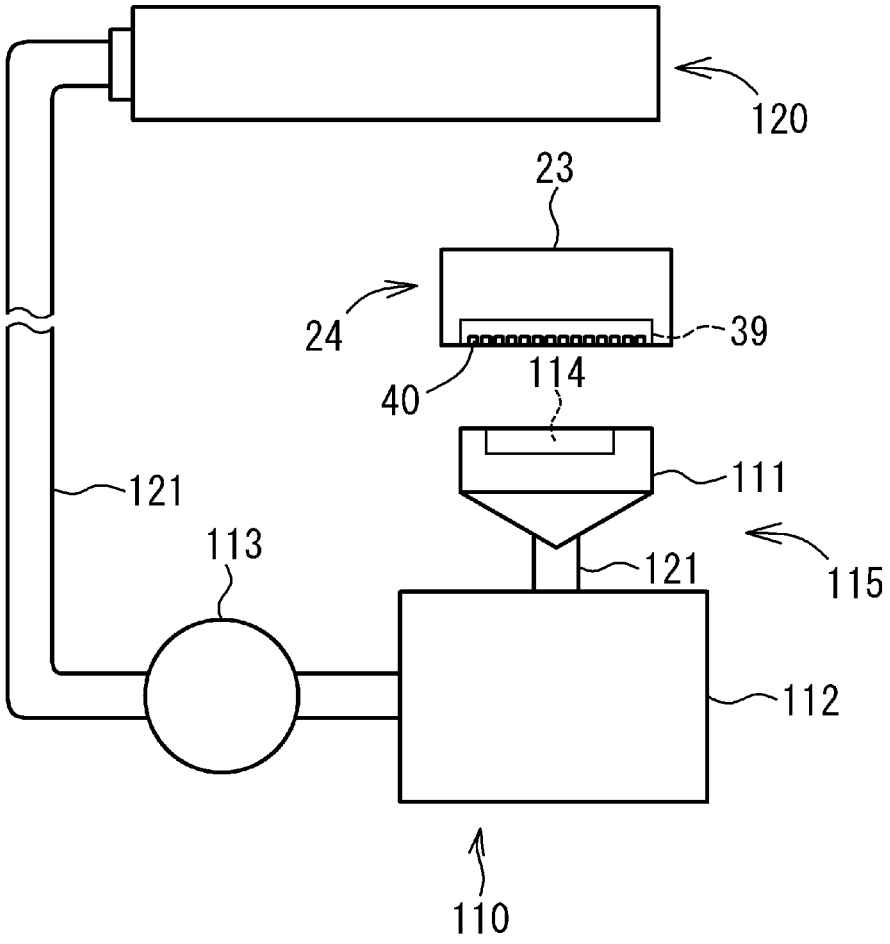

FIG. 5 schematically shows structures of a maintenance device and a waste ink tank of the MFP shown in FIG. 1.

Figure 6A:
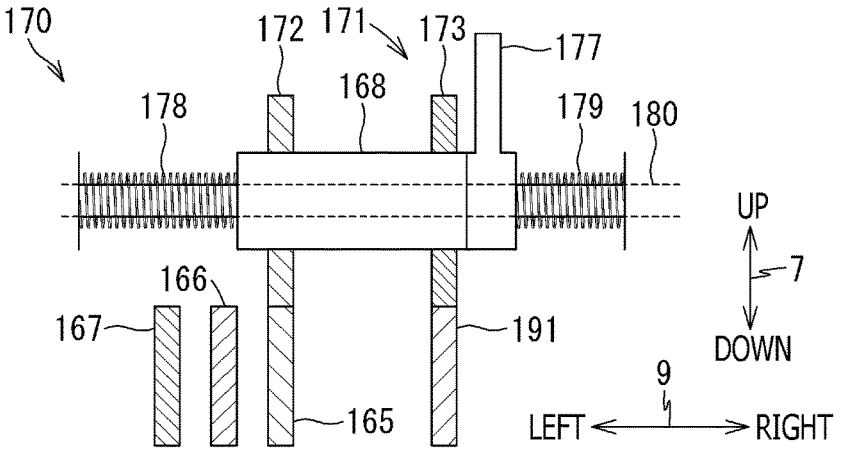

FIG. 6A schematically shows a structure of a switching mechanism of the MFP at a third state.

Figure 6B:
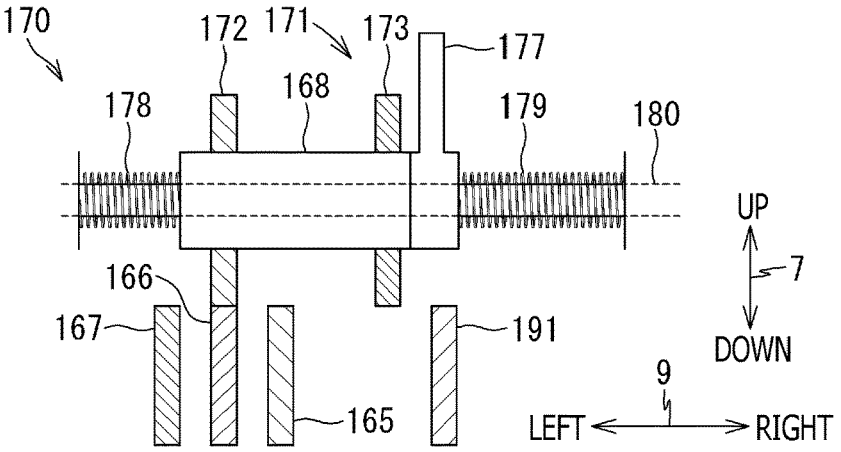

FIG. 6B schematically shows a structure of the switching mechanism of the MFP at a second state.

Figure 6C:
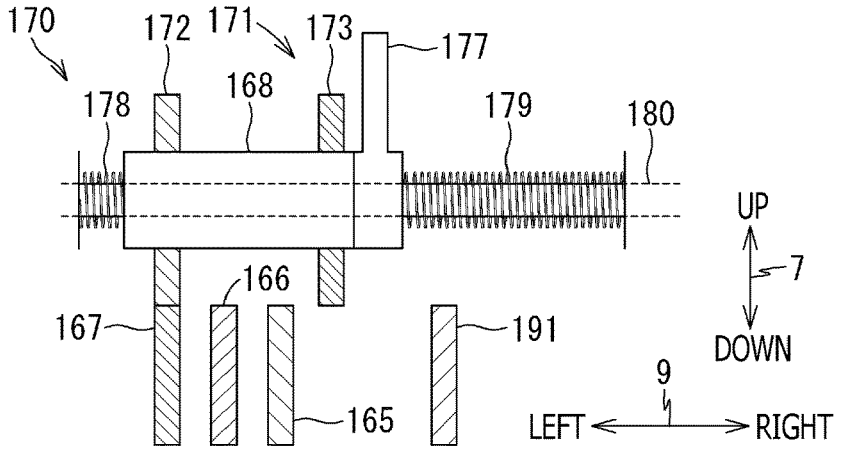

FIG. 6C schematically shows a structure of the switching mechanism of the MFP at a first state.

Figure 7A:
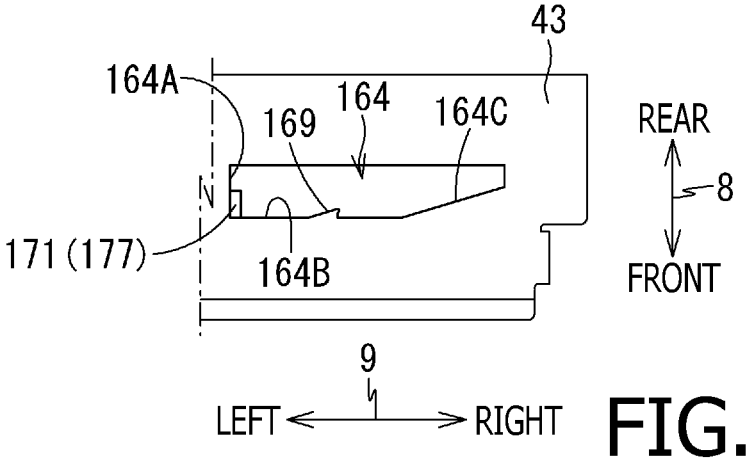

FIG. 7A is a plan view of a lever and the guide rail when a slidable member is located at a first position.

Figure 7B:
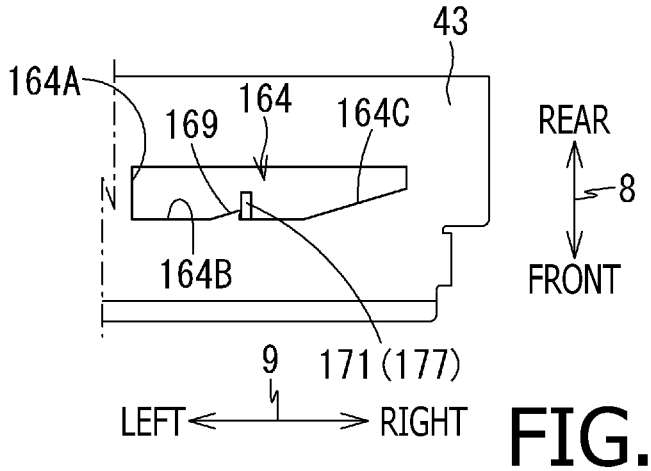

FIG. 7B is a plan view of the lever and the guide rail when the slidable member is located at a second position.

Figure 7C:
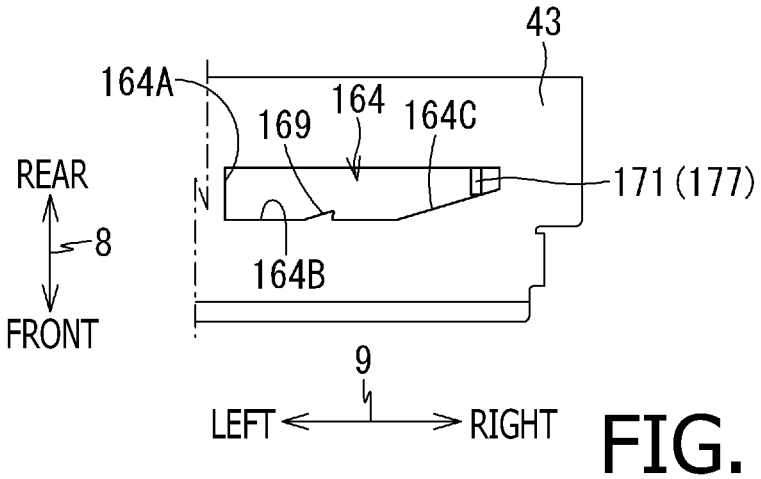

FIG. 7C is a plan view of the lever and the guide rail when the slidable member is located at a third position.

Figure 8:
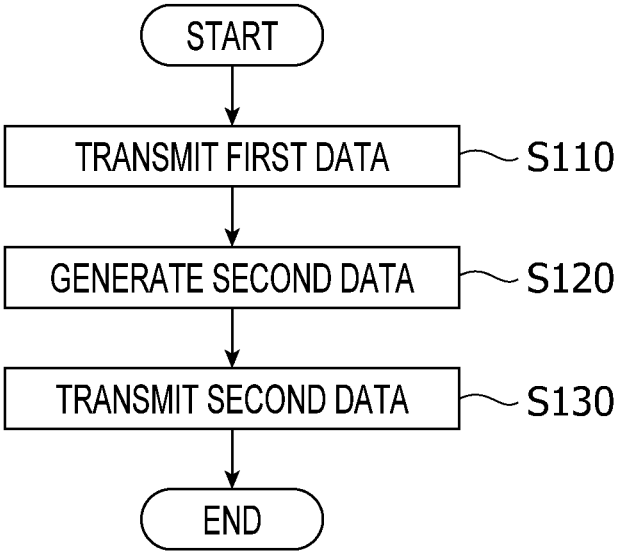

FIG. 8 is a flowchart illustrating a process executed by a controller of the information processing apparatus according to the illustrative embodiment when an printing operation is executed.

Figure 9:
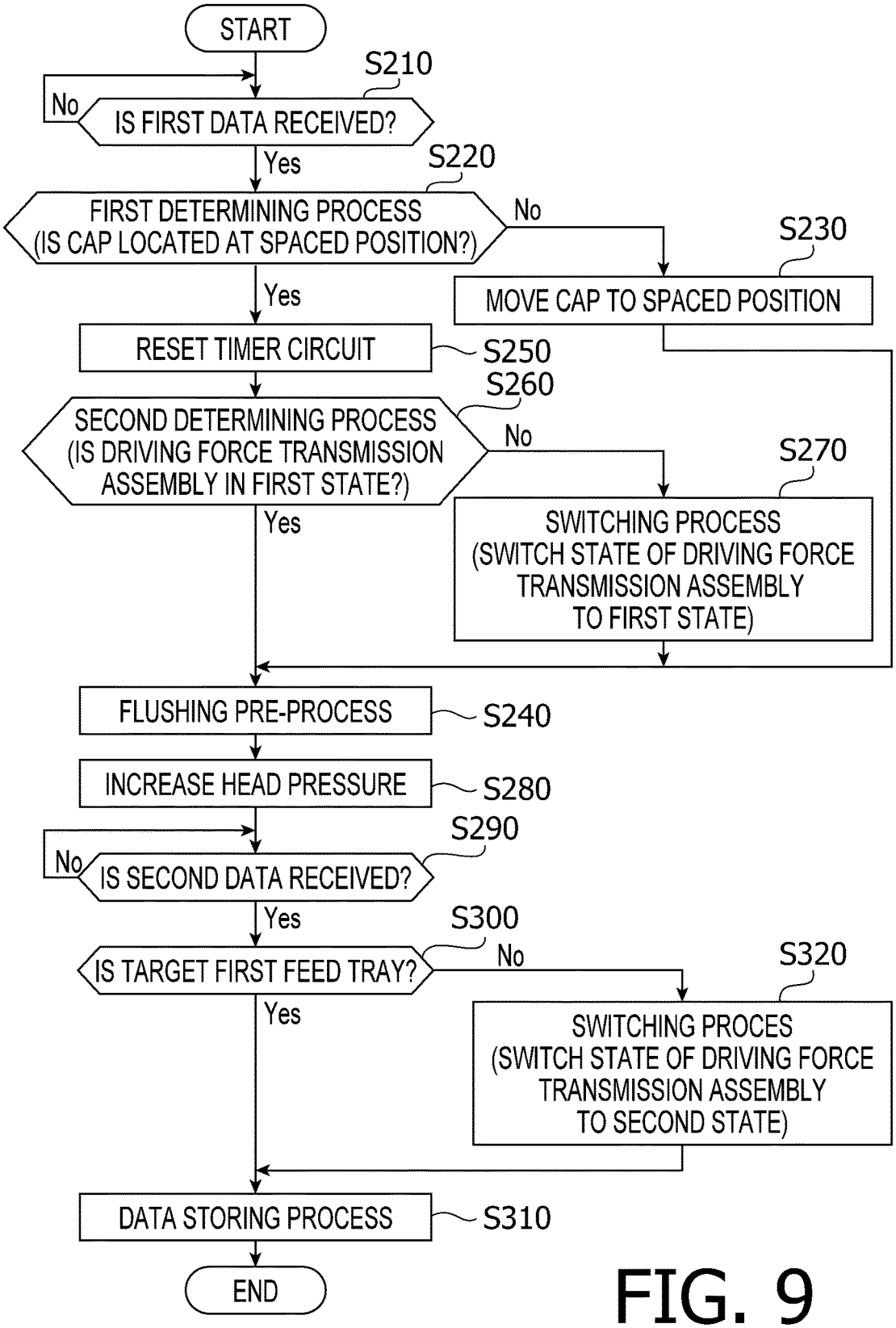

FIG. 9 is a flowchart illustrating a process executed by a controller of the MFP according to the illustrative embodiment when the printing operation is executed.

Figure 10:
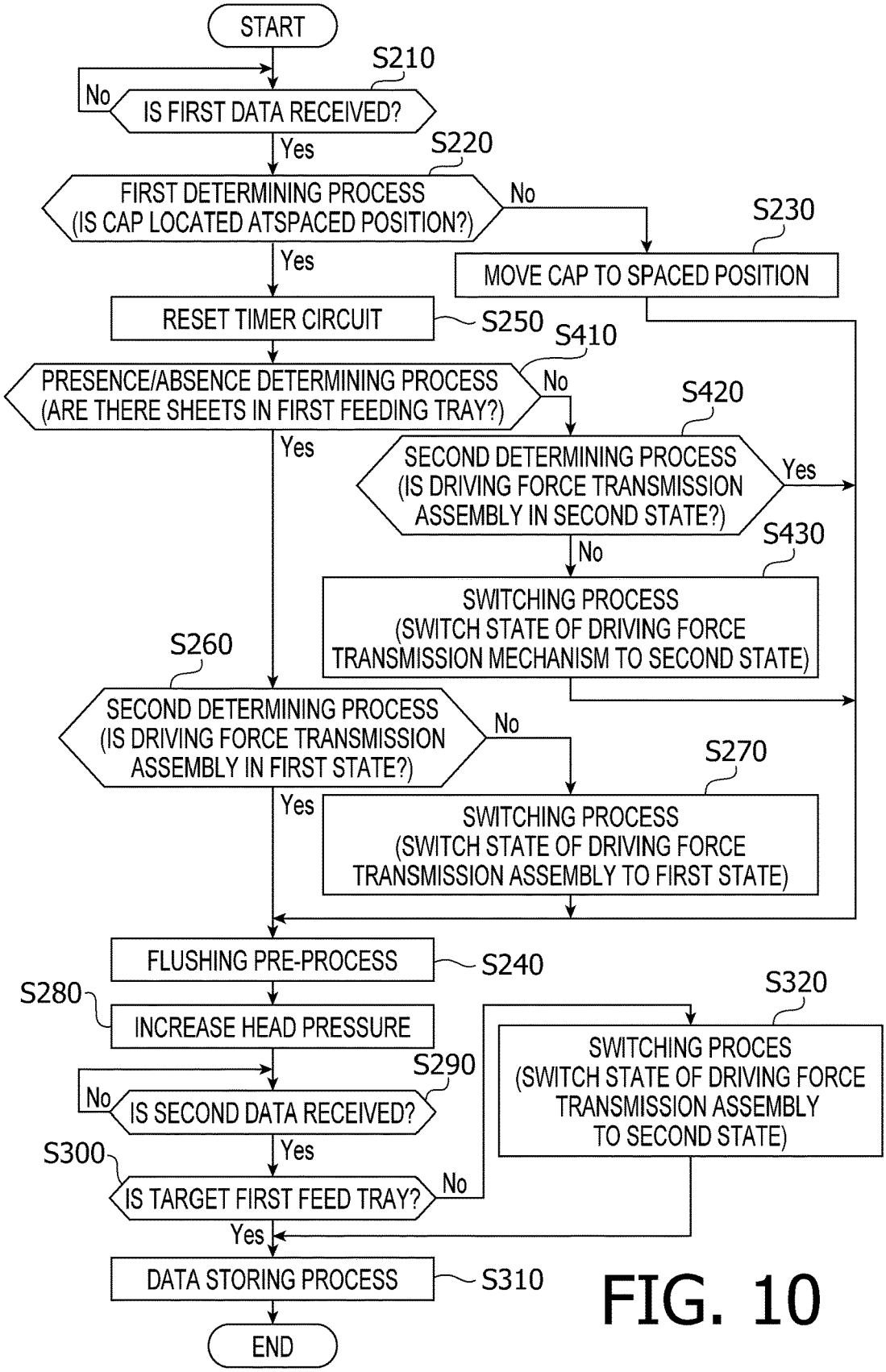

FIG. 10 is a flowchart illustrating a process executed by a controller of the MFP according to a first modification of the illustrative embodiment when the printing operation is executed.

Figure 11:
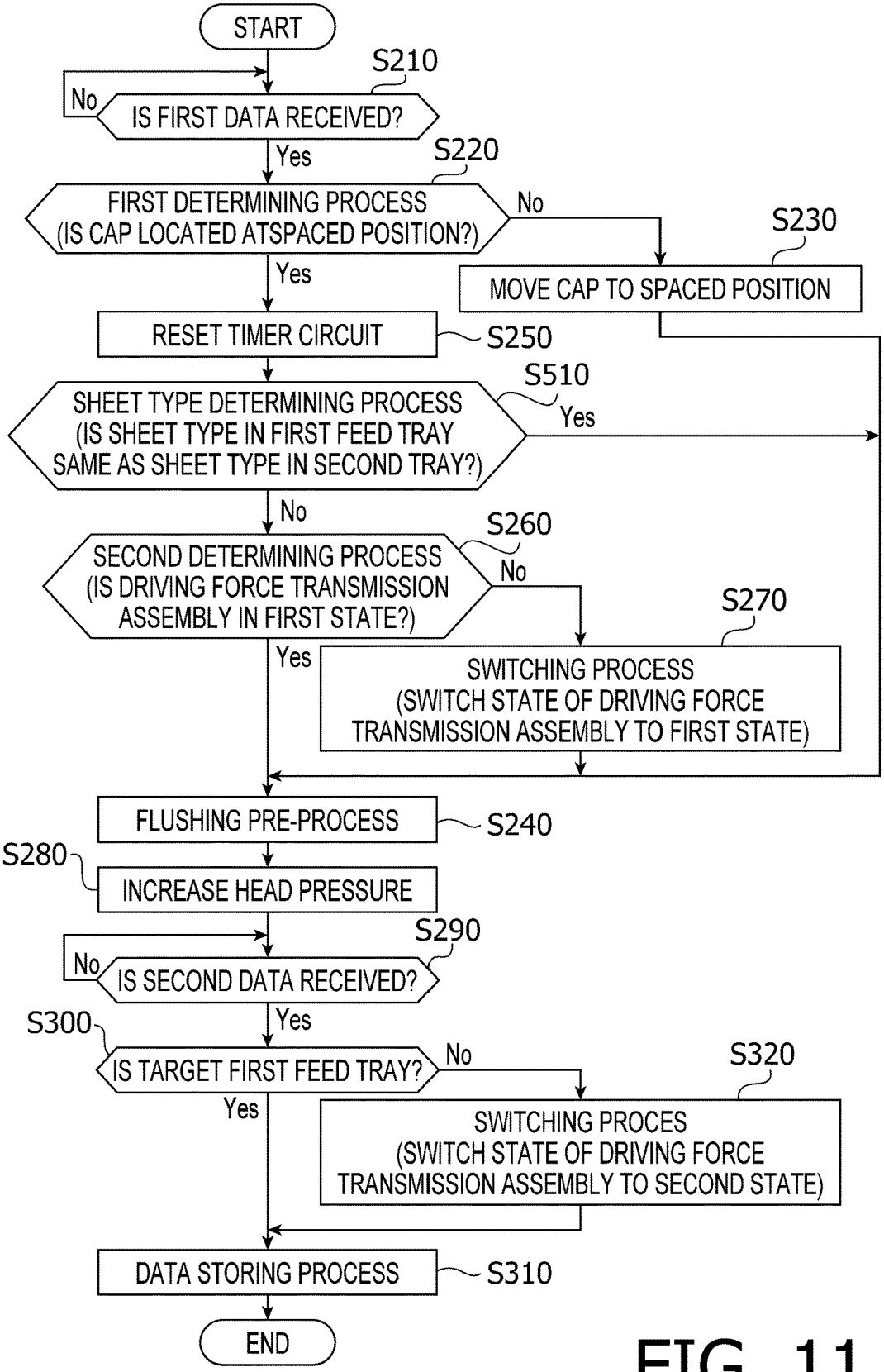

FIG. 11 is a flowchart illustrating a process executed by a controller of the MFP according to a second modification of the illustrative embodiment when the printing operation is executed.

DETAILED DESCRIPTION OF ILLUSTRATIVE EMBODIMENT

Hereinafter, an illustrative embodiment according to the disclosures will be described, referring to the accompanying drawings. It is noted that the illustrative embodiment described below is only one example according to the disclosures, and may be modified in various ways without departing from the aspects of the disclosures. In the following description, a term "direction" will be used to express a direction directed from a start point of an arrow toward an end point of the arrow, or a direction (regardless of its orientation) parallel to a line segment connecting the start point and the end point of the arrow. The former may also be expressed as an "orientation direction" in order to stress that the orientation should also be considered. Further, an up-down direction 7 is defined based on a state where an MFP (multi-function peripheral) 10 is placed for used (e.g., a state shown in FIG. 1). In the state as shown in FIG. 1, a front-rear side 8 is also defined such that a side where an opening 13 is formed is a front side. Further, a right-left side 9 is defined when the MFP 10 is viewed from the front side thereof.

<Overall Configuration of MFP>

Figure 2:
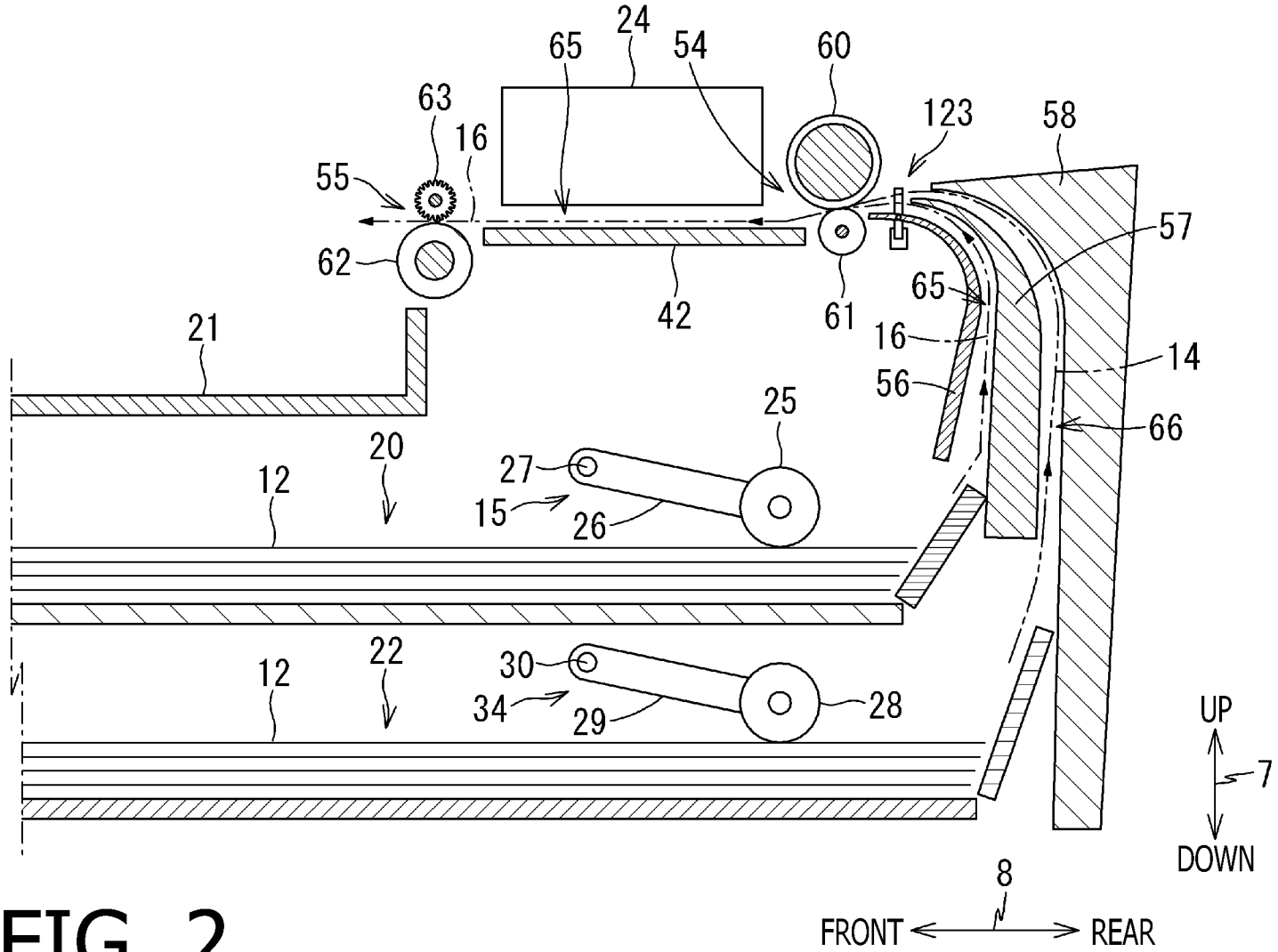
FIG. 2 is a partial cross-sectional view of a printer of the MFP shown in FIG. 1.

As shown in FIG. 2, the MFP 10 (which is an example of an inkjet printing apparatus) has a substantially rectangular parallelepiped shape. The MFP 10 is configured to execute a plurality of functions including a facsimile function and a printing function. In particular, the MFP 10 has a printer 11 configured to print an image on one side of a sheet 12. The printer 11 is arranged at a lower part of the MFP 10. It is noted that the printer 11 may be configured to print images on both sides of each sheet 12.

The printer 11 has a first feed tray 20, a second feed tray 22, a first feeder assembly 15, a second feeder assembly 34, a discharge tray 21, a conveyer assembly 54, a discharging assembly 55, a printer assembly 24, and a platen 42. The first feed tray 20 and the second feed tray 22 are examples of multiple trays. The first feed tray 20 is an example of a particular tray and a first tray. The second feed tray 22 is an example of a second tray. The first feeder assembly 15 and the second feeder assembly 34 are examples of multiple feeder assemblies. Further, the first feeder assembly 15 is an example of a particular feeder assembly.

Figure 3:
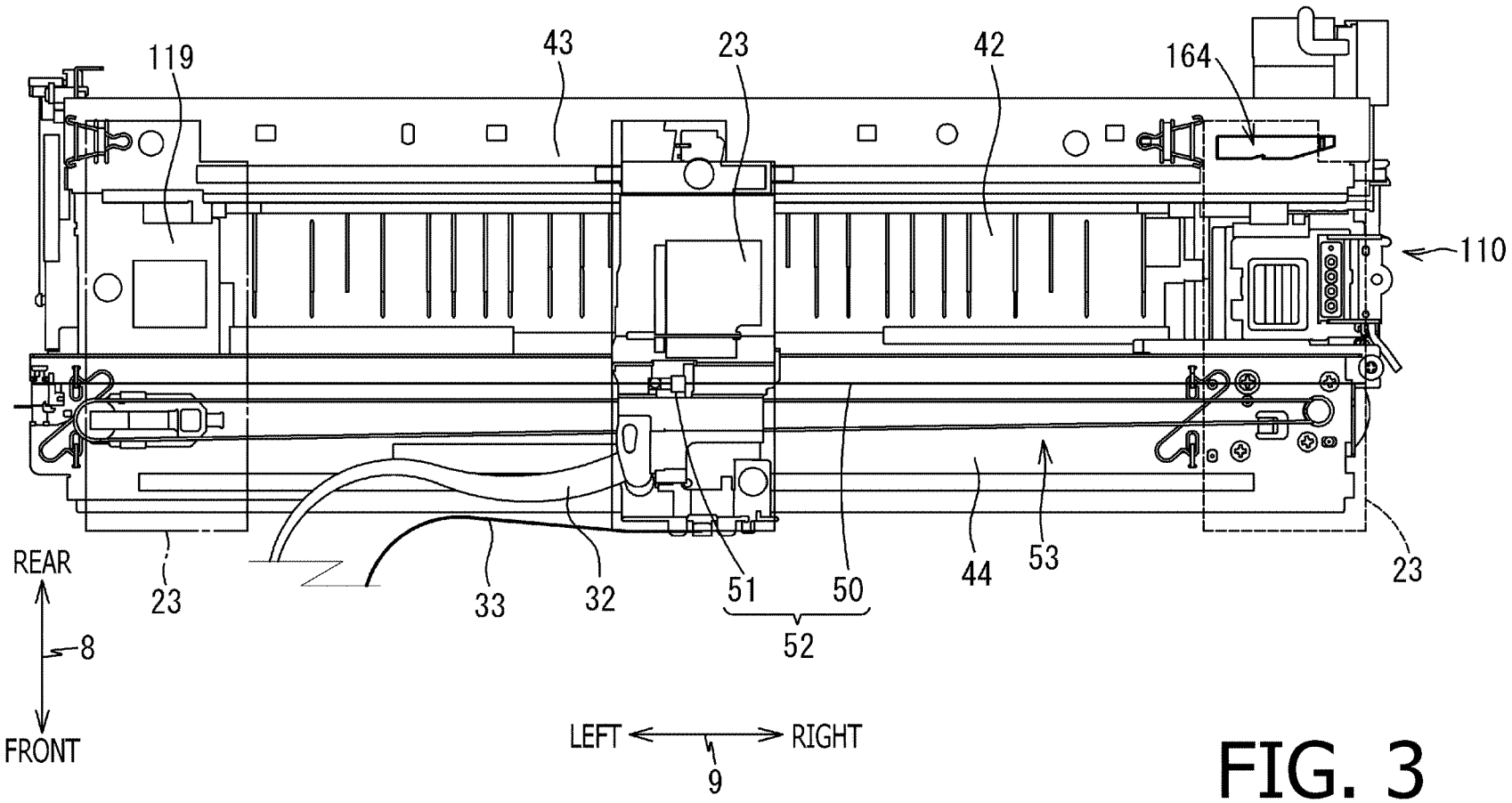
FIG. 3 is a plan view of a carriage and guide rails of the printer shown in FIG. 2.
Figure 4:
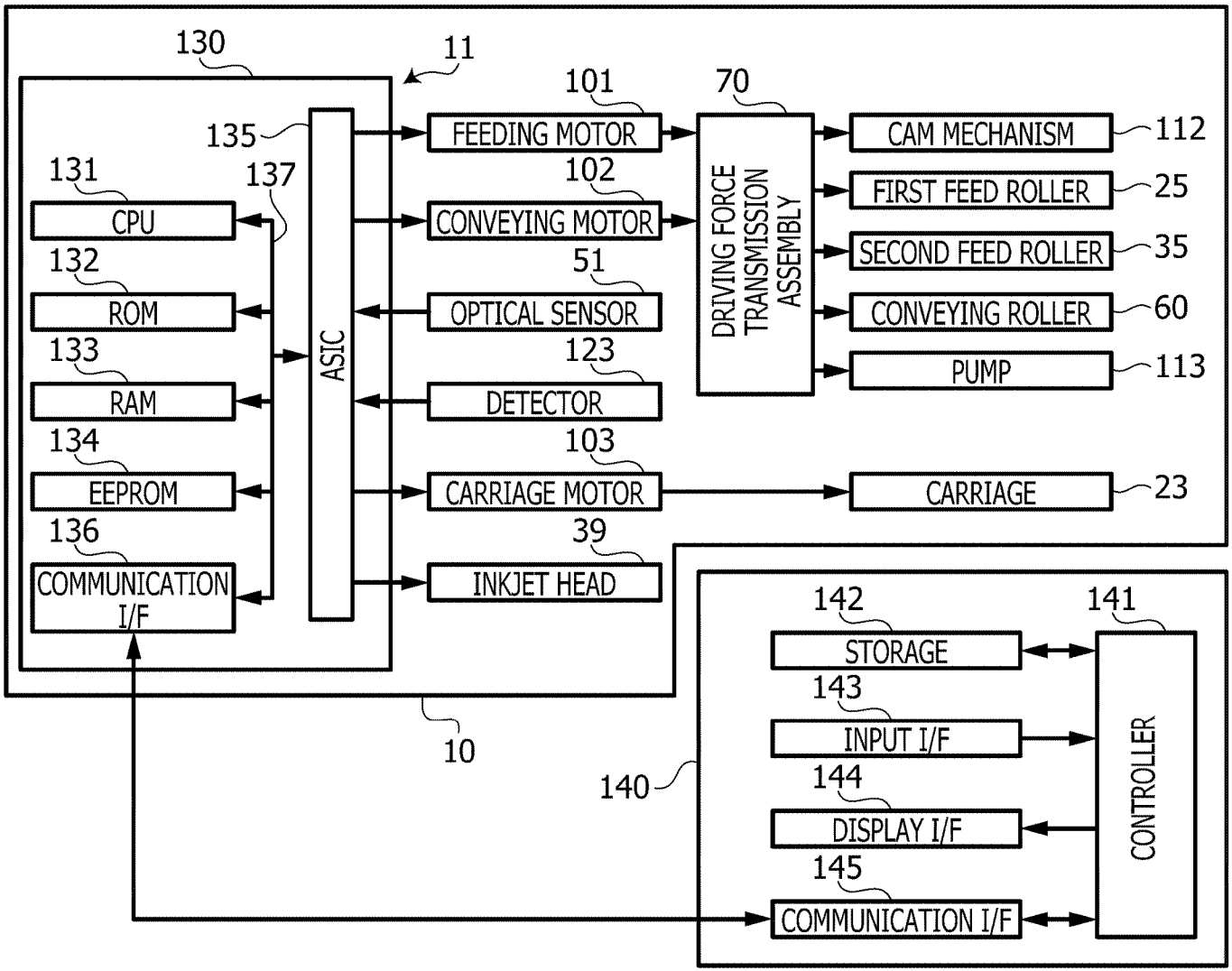
FIG. 4 is a block diagram of the MFP and an information processing apparatus according to the illustrative embodiment of the disclosures.

As shown in FIGS. 3 and 4, the printer 11 has a feeding motor 101, a conveying motor 102, a carriage motor 103, a controller 130, a driving force transmission assembly 70 and a maintenance device 110.

<First Feed Tray, Discharge Tray and Second Feed Tray>

As shown in FIGS. 1 and 2, the first feed tray 20 and the second feed tray 22 are attached to the printer 11 as being inserted rearward through an opening 13, and are detached from the printer 11 as being withdrawn frontward through the opening 13. The first feed tray 20 and the second feed tray 22 are, when attached to the printer 11, arranged at upper and lower stages. The first feed tray 20 is arranged above the second feed tray 22. Each of the first feed tray 20 and the second feed tray 22 is configured to support multiple sheets 12 in a stacked manner.

The discharge tray 21 is arranged above the first feed tray 20. The discharge tray 21 is configured to receive and support the sheets 12 discharged by the discharging assembly 55.

<First Feeder Assembly and Second Feeder Assembly>

The first feeder assembly 15 and the second feeder assembly 34 include the first feed tray 20 and the second feed tray 22, respectively.

As shown in FIG. 2, the first feeder assembly 15 has a first feeding roller 25, a first feeder arm 26 and a first shaft 27. The first feeding roller 25 is rotatably supported at a distal end part of the first feeder arm 26. The first feed roller 25 is configured to rotate in a direction (which will be referred to as a forward rotation) in which the sheet 12 supported by the first feed tray 20 is conveyed, in a conveying direction 16, toward a first conveying passage 65 as the feeding motor 101 (see FIG. 4) rotates in a forward direction. The first feeder arm 26 is rotatably supported by the first shaft 27, which is supported by a frame (not shown) of the printer 11.

The second feeder assembly 34 has a second feeding roller 28, a second feeder arm 29 and a second shaft 30. The second feeding roller 28 is rotatably supported at a distal end part of the second feeder arm 29. The second feed roller 28 is configured to rotate in the direction in which the sheet 12 supported by the second feed tray 22 is conveyed, in the conveying direction 14, toward a second conveying passage 66 as the feeding motor 101 (see FIG. 4) rotates in the forward direction. The second feeder arm 29 is rotatably supported by the second shaft 30, which is supported by the frame (not shown) of the printer 11.

Transmission of the driving force from the feeding motor 101 to the first feed roller 25 and the second feed roller 28 will be described in detail later.

<First Conveying Passage and Second Conveying Passage>

As shown in FIG. 2, the first conveying passage 65 and the second conveying passage 66 through which the sheets 12 pass are defined inside the printer 11.

The first sheet conveying passage 65 is a space defined by first guide member 56 and a second guide member 57 which face each other with a particular clearance therebetween, the conveyer assembly 54, the printer assembly 24, the platen 42 and the discharging assembly 55. The conveying direction 16 of the sheet 12 in the first conveying passage 65 is indicated by arrowed one-dotted line in FIG. 2.

The second sheet conveying passage 65 is a space defined by second guide member 57 and a third guide member 58 which face each other with a particular clearance therebetween. The second conveying passage 66 is formed on a rear side with respect to the first conveying passage 65. The second conveying passage 66 is connected to the first conveying passage 65 on an upstream side, in the conveying direction 16, with respect to the conveyer assembly 54. The conveying direction 14 of the sheet 12 in the second conveying passage 66 is indicated by arrowed two-dotted line in FIG. 2.

<Conveying Assembly>

The conveying assembly 54 is arranged on an upstream side, in the conveying direction 16 along the first conveying passage 65, with respect to the printer assembly 24. The conveying assembly 54 has a conveying roller 60 and a pinch roller 61, which face each other. The conveying roller 60 is driven by the conveying motor 102 (see FIG. 4) to rotate. The pinch roller 61 is driven to rotate in association with rotation of the conveying roller 60. The conveying roller 60 rotates forwardly as a forwardly rotating driving force of the conveying motor 102 is transmitted. It is noted that the forward rotation is defined as a rotation for conveying the sheet 12 nipped by the conveying roller 60 and the pinch roller 61 in the conveying direction 16.

<Discharging Assembly>

A discharging assembly 55 is arranged on a downstream side, in the conveying direction 16 along the first conveying passage 65, with respect to the printer assembly 24. The discharge roller assembly 55 has a discharging roller 62 and a spur roller 63. The discharging roller 62 is driven by the conveying motor 102 to rotate. The spur roller 63 rotates in association with rotation of the discharging roller 62. The sheet 12 is nipped by the discharging roller 62 and the spur roller 63, and conveyed along the conveying direction 16 as the forward rotation driving force of the conveying motor 102 is transmitted. It is noted that the forward rotation is defined as a rotation for conveying the sheet 12 nipped by the discharging roller 62 and the spur roller 63 in the conveying direction 16.

<Printer Assembly>

The printer assembly 24 is arranged between, in the conveying direction 16 along the first conveying passage 65, the conveying assembly 54 and the discharging assembly 55 as shown in FIG. 2. The printer assembly 24 is arranged above the platen 42 and to face the platen 42. The printer assembly 24 is provided with a carriage 23 and the inkjet head 39. As shown in FIG. 3, from the carriage 23, an ink tube 32 and a flexible flat cable 33 extend. The ink tube 32 serves to supply ink of the ink cartridge to the inkjet head 39 (see FIG. 2). The flexible flat cable 33 serves to electrically connect a control circuit board (not shown) implemented with the controller 130 with the inkjet head 39.

The carriage 23 is slidably supported by guide rails 43 and 44, which are arranged to be spaced in the front-read direction 8 and each of which extends in the right-left direction 9 as shown in FIG. 3. The carriage 23 is connected to a well-known belt-driving mechanism 53 provided to the guide rail 44. The belt-driving mechanism 53 is driven by the carriage motor 103 (see FIG. 4). That is, the carriage 23 is connected to a belt of the belt-driving mechanism 53, which belt is driven to circumferentially move by the carriage motor 103, thereby the carriage 23 being reciprocally moved in the right-left direction 9.

The inkjet head 39 is mounted on the carriage 23 as shown in FIG. 2. On a bottom surface of the inkjet head 39, multiple nozzles 40 are formed. The inkjet head 39 ejects ink as minute ink droplets through the multiple nozzles 40. Specifically, while the carriage 23 is moving, the inkjet head 39 ejects the ink droplets to the sheet 12 supported by the platen 42, thereby an image is formed on the sheet 12.

The carriage 23 is configured to reciprocate in the right-left direction 9 within a range where the inkjet head 39 is capable of ejecting the ink droplets to the sheet 12 when an image is printed on the sheet 12. Specifically, the carriage 23 reciprocally moves within the range where the inkjet head 39 is located above the conveying passage 65 and faces the same. In the following description, the above range where the carriage 23 reciprocally moves will be referred to as a recordation area.

It is noted that the carriage 23 can be moved to a non-recordation area which is defined on a right side with respect to the conveying passage 65, and to a flushing area which is defined on a left side with respect to the conveying passage 65. In FIG. 3, the carriage 23 located at the non-recordation area is indicated by broken lines, while the carriage 23 located at the flushing area is indicated by one-dotted lines.

The recordation area is a range within which the carriage 23 is located when images are printed on the sheet 12 by the inkjet head 39. The non-recordation area is a range where the carriage 23 is located when maintenance of the inkjet head 39 is performed. The maintenance of the inkjet head 39 will be described later. The flushing range is a range within which the carriage 23 is located when flushing of the inkjet head 39 is performed. The flushing of the inkjet head 39 will also be described later.

<Platen>

The platen 42 is arranged between, in the conveying direction 16, the conveying assembly 54 and the discharge assembly 55 as shown in FIG. 2. Further, the platen 42 is arranged to face, in the up-down direction, the printer assembly 24. The platen 42 is arranged below the printer assembly 24 and faces the printer assembly 24. The platen 42 is configured to support the sheet 12, which is conveyed by the conveying assembly 54, from below.

<Linear Encoder>

As shown in FIG. 3, an encoder strip 50 is provided to the guide rail 44. The encoder strip 50 is a belt-like strip made of transparent or light-transmitting resin. The encoder strip 50 is laid in the right-left direction 9 with its right and left ends being locked by supporting ribs (not shown), respectively.

Specifically, on the encoder strip 50, a pattern having light-transmitting parts and light-shielding parts which are alternately arranged at equal pitch is formed. Further, at a position, on the carriage 53, corresponding to the encoder strip 50, an optical sensor 51, which is a light transmitting type sensor, is provide. A linear encoder 52, which is used to detect a location of the carriage 23 along the guide rail 44, is configured with the encoder strip 50 and the optical sensor 51. A detection signal generated by the optical sensor 51 is transmitted to the controller 130 (see FIG. 4), which will be described in detail later.

<Detector>

As shown in FIG. 2, a detector 123 is arranged at a position, in the conveying passage 65, on an upstream side, in the conveying direction, with respect to the conveyer assembly 54. The detector 123 transmits a low-level signal to the controller 130 in response to absence of the sheet 12 on the detector 123. Further, the detector 123 transmits a high-level signal to the controller 130 in response to presence of the sheet 12 which has been conveyed onto the detector 123.

<Maintenance Device and Waste Ink Tank>

The maintenance device 110 shown in FIG. 5 is used for maintenance of the inkjet head 39. Specifically, the maintenance device 110 performs a purge operation to remove, by suction, the ink and/or air in the nozzles 40 and foreign matters adhered onto a nozzle face (i.e., a face of the inkjet head 39 on which the multiple nozzles 40 are formed), which will collectively be referred to as the "ink and the like."

The waste ink tank 120 is arranged below a moving path of the carriage 23. The waste ink tank 120 accommodates a well-known ink absorbing member. The waste ink tank 120 is configured to accommodate the ink and the like sucked from the nozzles 40 as the ink absorbing member absorbs the ink. It is noted that, FIG. 5 schematically shows the waste ink tank 120 is in order to show that the maintenance device 110 and the waste ink tank 120 is connected with a tube 121, and does not intended to show a positional relationship of the waste ink tank 120 and the other components.

The maintenance device 110 has a capping device 115, which includes a movable part 111 and a cam mechanism 112 configured to move the movable part 111 in the up-down direction 7, the tube 112 through which the ink flows, and a pump 113 configured to such the ink.

A cap 114 made of rubber material is provided to the movable part 111. The cap 114 is arranged below the carriage 23 and at a position on a right side with respect to the recordation area so as to face the carriage 23 which is also located on the right side with respect to the recordation area. Specifically, the cap 114 is arranged below the multiple nozzles 40 formed on the nozzle face of the inkjet head 39 and to face the same when the carriage 23 is located at the position on the right side with respect to the recordation area.

The cam mechanism 112 is driven by the feeding motor 101 (see FIG. 4) and moves the movable member 111 in the up-down direction 7. The cap 114 moves, as the driving force is transmitted from the feeding motor 101, between a spaced position where the cap 112 does not cover the nozzles 40, and a covering position where the cap contacts the lower face of the inkjet head 39 and covers the multiple nozzles 40. The cap 114 contacts the lower face of the inkjet head 39 mounted on the carriage 23 located at the non-recordation area as the movable part 111 is moved upward. In that state, the cap 114 covers the nozzles 40. Thereafter, as the cap 114 is moved downward, the cap 114 is moves away and spaced from the nozzles 40.

To the cap 114, one end of the tube 121 is connected. The tube 112 is a resin tube having elasticity. The other end of the tube 121 is connected to the waste ink tank 120.

The pump 113 is, for example, a rotary type tube pump. The pump 113 is configured, as driven by the conveying motor 102 (see FIG. 4), to suck the ink and the like in the nozzles 40 through the cap 114 and the tube 121 and discharge the same to the waste ink tank 120 through the tube 121.

<Ink Receiver>

As shown in FIG. 3, an ink receiver 119 is arranged below the moving path of the carriage 23 and on the left side with respect to the left end of the platen 42. The ink receiver 119 is located at a position immediately below the carriage 23 when the carriage 23 is located at the flushing area. The ink receiver 119 has a substantially rectangle parallelepiped shape of which upper side is opened to outside. The ink receiver 119 accommodates the well-known ink absorbing member. The ink receiver 119 is configured to receive idle discharging of the ink and the like, which is known as "flushing", of the inkjet head 39 from the above. The ink and the like discharged according to the idle discharging from the inkjet head 39 is absorbed by the ink absorbing member and retained thereby.

<Driving Force Transmission Assembly>

The printer 11 further includes, as shown in FIG. 4, the driving force transmission assembly 70. The driving force transmission assembly 70 is configured to transmit the driving forces of the feeding motor 101 and the conveying motor 102 to a first feed roller 25, a second feed roller 35, the conveying roller 60, the discharging roller 62, the cam mechanism 112, and the pump 113. The driving force transmission assembly 70 is configured by combining all or parts of gears, pulleys, an endless annular belt, planetary gear mechanisms (pendulum gear mechanisms) and/or one-way clutches. Further, the driving force transmission assembly 70 has the switching mechanism 170 (see FIG. 6) configured to switch destinations to which the driving forces of the feeding motor 101 and the conveying motor 102 are to be transmitted.

<Switching Mechanism>

The switching mechanism 170 is configured to operate in a first state, a second state and a third state. In the first state, the driving force of the conveying motor 102 is transmitted to the conveying roller 60 and the discharging roller 62, but not to the pump 113. Further, in the first state, the destination of the driving force of the feeding motor 101 is the first feeding roller 25.

In the second state, the driving force of the conveying motor 102 is transmitted to the conveying roller 60 and the discharging roller 62, but not to the pump 113. Further, in the second state, the destination of the driving force of the feeding motor 101 is the second feed roller 28.

In the third state, the driving force of the conveying motor 102 is transmitted to the conveying roller 60, the discharging roller 62 and the pump 113, for the driving force of the feeding motor 101 is transmitted to the cam mechanism 112.

The switching mechanism 170 is arranged at a position immediately below the carriage 23 when the carriage 23 is located at the non-recordation area. As shown in FIG. 6, the switching mechanism 170 mainly has a slidable member 171 including a main part 168 and a lever 177, driving gears 172 and 173, driven gears 165, 166, 167 and 191, springs 178 and 179, and a supporting shaft 180.

The main part 168 of the slidable member 171 is a substantially cylindrical member supported by the supporting shaft 180 which extends in the right-left direction 9. The main part 168 of the sliding member 171 is configured to be slidable in the right-left direction 9 along the supporting shaft 180. Further, the main part 168 of the sliding member 171 rotatably supports the driving gears 172 and 173, which are configured to be independently rotatable on the outer circumferential surface of the slidable member 171, at different positions in the right-left direction 9. It is noted that, in the right-left direction 9, the slidable member 171 moves integrally with the driving gears 172 and 173.

The driving gear 172 rotates as the rotational driving force of the feeding motor 101 is transmitted. It is noted that the driving gear 172 is configured to engage with one of the driven gears 165, 166 and 167. Specifically, the driving gear 172 engages with the driven gear 165 when the switching mechanism 170 is in the first state (see FIG. 6A). The driving gear 172 engages with the driven gear 166 when the switching mechanism 170 is in the second state (see FIG. 6B). The driving gear 172 engages with the driven gear 167 when the switching mechanism 170 is in the third state (see FIG. 6C).

The driving gear 173 rotates as the rotational driving force of the conveying motor 102 is transmitted. It is noted that the driving gear 173 engages with the driven gear 191 when the switching mechanism 170 is in the third state (see FIG. 6A). Further, the driving gear 173 disengaged from the driven gear 191 when the switching mechanism 170 is in the first or second state (see FIG. 6B or 6C).

The driven gear 165 engages with a gear train that drives the cam mechanism 112. That is, the rotational driving force of the feeding motor 101 is transmitted to the cam mechanism 112 as the driving gear 172 engages with the driven gear 165, thereby moving the cap 114 in the up-down direction 7. Further, the rotational driving force of the feeding motor 101 is not transmitted to the cam mechanism 112 when the driving gear 172 is disengaged from the driven gear 165.

The driven gear 166 engages with a gear train which rotates the second feed roller 28. The rotational driving force of the feeding motor 101 rotates the second feed roller 28 as the driving gear 172 engages with the driven gear 166. When the driving gear 172 is disengaged from the driven gear 166, the rotation driving force of the feeding motor 101 is not transmitted to the second feed roller 28.

The driven gear 167 engages with a gear train which rotates the first feed roller 25. That is, the rotational driving force of the feeding motor 101 rotates the first feed roller as the driving gear 172 engages with the driven gear 167. Further, the driving force of the feeding motor 101 is not transmitted to the first feed roller 15 when the driving gear 172 is disengaged from the driven gear 167.

The driven gear 191 engages with a gear train which drives the pump 113. That is, the driving force of the conveying motor 102 drives the pump 113 as the driving gear 173 engages with the driven gear 191. The rotational driving force of the conveying roller 113 is not transmitted to the pump 113 when the driving gear 173 is disengaged from the driven gear 191.

The driving force of the conveying motor 102 is transmitted to the conveying roller 69 and the discharging roller 62 without being transmitted through the switching mechanism 170. That is, the conveying roller 60 and the discharging roller 62 are driven by the rotational force of the conveying motor 102 regardless of the operating state of the switching mechanism.

The lever 177 of the slidable member 171 is supported by the supporting shaft 180 at a position, in the right-left direction 9, on the right side of the main part 168. Further, the lever 177 is configured to slide in the right-left direction 9, along the supporting shaft 180. Further, the lever 177 protrudes upward. A tip end of the lever 177 extends through an opening 164 formed on the guide rail 43 and reaches a position at which the tip end of the lever 177 could contact the carriage 23.

The springs 178 and 179 are supported by the supporting shaft 180. The spring 178 is arranged such that one end (i.e., left end) thereof contacts a frame of the printer 11, while the other end (i.e., right end) thereof contacts a left end face of the main part 168. That is, the spring 178 urges the main part 168 and the lever 177 of the slidable member 171 which contacts the main part 168 rightward.

The spring 179 is arranged such that one end (i.e., right end) thereof contacts the frame of the printer 11, while the other end (i.e., left end) thereof contacts the right end face of the lever 177. That is, the spring 179 urges the lever 177 and the main part 168 which contacts the lever 177 leftward. Further, it is noted that the urging force of the spring 179 is greater than that of the spring 178. Further, the spring 179 urges the lever 177 in a direction along the circumference of the supporting shaft 180, that is, in a direction where the lever 177 moves frontward.

The switching mechanism 170 operates in the first state as shown in FIG. 6C when the carriage 23 is about to move away from the lever 177. At this stage, the lever 177 is urged leftward by the spring 179 as shown in FIG. 7A, thereby contacting a left side edge part 164 of the opening 164, and urged in a circumferential direction by the spring 179, thereby contacting a front edge part 164B of the opening 164. It is noted that the position of the slidable member 170 in the above state (see FIG. 6C and FIG. 7A) is a first position.

Further, the lever 177 pushed rightward by the carriage 23 moves rightward against the urging force of the spring 179. Then, the main part 168, from which the lever 177 is spaced, is moved rightward by the urging force of the spring 178. Then, as shown in FIG. 6B, the lever 177 engages with a convex part 169, which protrudes from the edge part 165B. As a result, the switching mechanism 170 changes its operating state from the first state shown in FIG. 6C to the second state shown in FIG. 6B. The position of the slidable member 171 at this state (i.e., the state shown in FIG. 6B or FIG. 7B) is a second position. That is, in association with the change of state of the switching mechanism 170 from the first state to the second state, the slidable member 171 moves from the first position to the second position.

In a state shown in FIG. 6B, the lever 177 pushed rightward by the carriage 23 is moved rightward against the urging force of the spring 179. Then, the main part 168, from which the lever 177 is spaced, is moved rightward by the urging force of the spring 178. As a result, the switching mechanism 170 changes its operating state from the second state shown in FIG. 6B to a third state shown in FIG. 6A. It is noted that during the change of the state from the second state to the third state, the lever 177 is guided rearward along an inclined surface 164C provided at a right end part of the edge 168, against the urging force in the rotating direction of the spring 178. It is noted that the position of the slidable member 171 in the above state (i.e., the position shown in FIG. 6A or FIG. 7C) is a third position. That is, in association with the change of the state of the switching mechanism 170 from the second state to the third state, the slidable member 171 moves from the second position to the third position.

In the state shown in FIG. 6A, when the carriage 23 moves leftward and is spaced from the lever 177, the main part 168 and the lever 177 move leftward against the urging force of the spring 179. As a result, the switching mechanism 170 changes its operating state from the third state shown in FIG. 6A to the first state shown in FIG. 6C. That is, in association with the change of state of the switching mechanism 170 from the third state to the first state, the slidable member 171 moves from the third position to the first position, in this order.

As described above, the switching mechanism 170 changes its operation state from the first state to the second state, then from the second state to the third state, and then from the third state to the first state, in association with the approaching/separating movement of the carriage with respect to the lever 177. That is, the destination of the driving forces of the feeding motor 101 and the conveying motor 102 is switched by the carriage 23. Further, in association with the change of the operation state of the switching mechanism 170, the slidable member 171 moves from the first position to the second position, from the second position to the third position, and from the third position to the first position, in this order.

<Controller>

As shown in FIG. 4, the controller 130 has a CPU (central processing unit) 131, a ROM (read only memory) 132, a RAM (random access memory) 133, an EEPROM (electrically erasable ROM) 134, ASIC (application specific integrated circuit) 135 and a communication I/F (interface) 136, which are interconnected through an internal bus 137. The ROM 132 stores programs which, when executed by the CPU 131, control operations of the MFP 10. The RAM 133 is used as a storage to temporarily store data and/or signals the CPU 131 uses when executing the programs, and/or as a work area used when data processing is performed. The EEPROM 134 is configured to store settings and flags to be retained even after the MFP 10 is powered off.

The ASIC 135 is connected with the feeding motor 101, the conveying motor 102, and the carriage motor 103. The ASIC 135 is configured to generate driving signals to rotate respective motors, and control the above motors with the driving signals. Each of the feeding motor 101, the conveying motor 102, and the carriage motor 103 rotates forwardly/reversely in accordance with the driving signals supplied by the ASIC 135. For example, the controller 130 controls the feeding motor 101 to rotate each of the feed rollers 25 and 25, or to drive the cam mechanism 112. Further, the controller 130 controls the conveying motor 102 to rotate each of the rollers 60 and 62, or to drive the pump 114. Furthermore, the controller 130 control the carriage motor 103 to move the carriage 23 reciprocally.

Further, the controller 130 controls the inkjet head 39 to eject the ink droplets through the nozzles 40. Specifically, the controller 130 selectively supplies driving voltages, from a head control circuit board which is provided to the inkjet head 39, to piezo elements provided to respective nozzles 40 so that the ink droplets are selectively ejected from the nozzles 40.

Further, the ASIC 135 is provided with a timer circuit configured to perform counting of elapsed time. It is noted that counting of the elapsed time may alternatively be performed by executing a time counting program stored in the ROM 132. The timer circuit mentioned above will be described in detail later.

It is also noted that the ASIC 135 is connected with the optical sensor 51 of the linear encoder 52. The CPU 131 calculates a position of the carriage 23 based on the detection signal output by the optical sensor 51. Specifically, the controller 130 moves the carriage 23 until the carriage 23 contact a frame provided on the right side or left side with respect to the conveying passage 65, and determines the position where the carriage 23 contacts the frame as an origin position. Thereafter, as the carriage 23 moves and the optical sensor 51 output the detection signal, the controller 130 calculates a moving amount of the carriage from the origin position based on the detection signal, thereby calculating the current position of the carriage 23.

Further, the ASIC 135 is connected with the detector 123. The controller 130 detects an upstream end (i.e. the trailing end) and a downstream end (i.e., the leading end), in the conveying direction 12, of the sheet 12 based on the detection signal of the detector 123.

The communication I/F 136 is configured to perform data communication with the information processing apparatus 140 such as a personal computer. For example, the communication I/F 136 can be connected with the information processing apparatus 140 using a wired LAN (local area network) communication, a wireless LAN communication, a USB (universal serial bus) communication, or a Bluetooth® communication. The communication interface 136 is, as will be described in detail later, configured to receive first data, which is transmitted by the information processing apparatus 140. Further, the communication interface 136 is further configured to receive second data, which the information processing apparatus 140 transmits after transmitting the first data.

<Information Processing Apparatus>

As shown in FIG. 4, the information processing apparatus 140 has a controller 141 including a CPU, a RAM and the like, a storage 142, an input I/F 143, a display I/F 144 and a communication I/F 145. The controller 141 is configured to integrally control respective components of the information processing apparatus 140.

The storage 142 includes, for example, a hard disk drive. The storage 142 stores programs to be executed by the controller 141. The programs include, for example, application programs such as one realizing a word processor, printer drivers and the like.

The input I/F 143 has, for example, a keyboard, a mouse and the like. As the user operates the keyboard, the mouse and the like, the input I/F 143 receives operation signals. The operation signals thus received are transmitted to the controller 141. The display I/F 144 has, for example, an LCD (liquid crystal display) or the like.

The communication I/F 145 is configured to perform data communication with the MFP 10. The communication I/F 145 is controlled by the controller 141 and transmits the first data to the MFP 10, and thereafter the second data to the MFP 10.

<Process Executed by Controller of Information Processing Apparatus>

Hereinafter, referring to FIG. 8, a process executed by the controller 141 when printing on the sheets 12 will be described. The controller 141 executes the process shown in FIG. 8 when the controller 141 receives a print instruction by the user through the application program.

When the print instruction is received, the controller 141 transmits the first data to an apparatus designated by the user as a destination device (which is the MFP 10 according to the illustrative embodiment) in S110. The first data is data which instructs to start print preparation. The print preparation includes a process to move the cap 114 from the covering position to the spaced position, and a process to move the carriage 23 to the flushing area. It is noted that the print preparation may include further processes. For example, if the MFP 10 is provided with a locking mechanism configured to lock the carriage 23 at the non-recordation area, the print preparation may include a process to release the lock of the carriage 23 by the locking mechanism.

Next, the controller 141 converts the document data and/or image data designated by the user and subjected to printing to the second data to be printed on the sheet 12 in accordance with a printing condition designated by the user (S120). For example, the second data is data in which the document data and/or image data is expressed by page description language. At a top of the second data, data indicating an image recordation condition. Examples of the image recordation condition may include a target tray, which is a tray supporting the sheets 12 to be fed (i.e., one of the first feed tray 20 and the second feed tray 22), the size of the sheet 12, the number of copies to be printed, indication of special printing (e.g., enlarged printing, reduced printing, the number of pages in multi-page printing to print designated number of pages on one side of the sheets).

Next, the controller 141 sequentially transmits the second data having been converted to the MFP 10 (specifically, to the communication I/F 136 of the MFP 10) in S130. The controller 141 is configured to generate the second data for ever image unit to be printed on the sheet 12 by one-way movement of the carriage 23 in the right-left direction 9 (hereinafter, such unit data will be referred to as one-path second data), and sequentially transmits the second data on the one-path amount basis.

<Process Executed by Controller of MFP>

Hereinafter, referring to the flowchart shown in FIG. 8, a process, regarding printing images on the sheets 12, executed by the controller 130 will be described.

The process is executed by the CPU 131 of the controller 130. It is noted that the process and/or respective steps described below may be executed as the CPU 131 retrieves and executes the programs stored in the ROM 132, or realized by a hardware circuit mounted to the controller 130. According to the illustrative embodiment, it is assumed that the carriage 23 is located at the non-recordation area in the initial state.

The controller 130 waits for receipt of the first data, which is transmitted by the information processing apparatus 140, through the communication I/F 136 (S210: NO). In response to receipt of the first data (S210: YES), the controller 130 executes a first determining process (S220) to determine whether the cap 114 is located at the spaced position or the covering position.

It is noted that determination of the position of the cap 114 is executed, for example, based on the output signal of a sensor which is configured to output different signals depending on locations of the cap 114. It is further noted that a method of determining the position of the cap 114 need not be limited to the above-described method. For example, the controller 130 may determine the cap position based on the position of the carriage 23 which is calculated based on the output signals of the optical sensor 51 of the linear encoder 52. In such a case, the capping device 115 may be configured as indicated below. That is, as the capping device 115 is pushed by the carriage 23, which moves rightward, the cap 114 moves from the spaced position to the covering position. When the carriage 23 moves rightward and away from the capping device 115, the cap 114 moves from the covering position to the spaced position.

In response to determination that the cap 114 is located at the covering position (S220: NO), the controller 130 executes print preparation based on the first data. That is, the controller 130 moves the cap 114 from the covering position to the spaced position (S230), and thereafter executes a flushing pre-process (S240) to move the carriage 23 to the flushing area.

In S230, the controller 130 moves the carriage 23 rightward to move the sliding member 171 to the third position, thereby setting the switching mechanism 170 to the third state (see FIGS. 6A and 7C), so that the driving force of the feeding motor 101 to the cam mechanism 112. Then, the cap 114 moves downward, from the covering position to the spaced position.

In S240, the controller 130 moves the carriage 23 leftward, from the non-recordation area to the flushing area through the recordation area. With this movement, the carriage 23 faces the ink receiver 119. It is noted that, in association with the movement of the carriage 23, the slidable member 171 moves to the first position. That is, the driving force transmission assembly 70 becomes in the first state.

When the cap 114 is located at the spaced position (S220: YES), the controller 130 resets the timer circuit (S250).

The timer circuit starts measuring time in response to completion of a recordation process which is started as the controller 130 receives the second data transmitted by the information processing apparatus 140, that is, in response to completion of recordation of an image on the sheet 12 regarding the second data.

In response to elapse of a preset threshold time period measured by the timer, the controller 130 executes a capping process to move the cap 114 from the spaced position to the covering position, and a voltage dropping process to drop the driving voltage applied to the inkjet head 39 to zero. Further, the controller 130 resets the timer circuit at this stage.

It is noted that the carriage 23 moves reciprocally during execution of the recording process. For this purpose, the controller 130 moves the cap 114 to the spaced position (S220: YES, S230) during the print preparation. The controller 130 starts moving cap 114, which is located at the spaced position during execution of the recordation process, toward the covering position when a particular time has elapsed after completion of the recordation process.

It is noted that the controller 130 moves the carriage 23 to the non-recordation area before moving the cap 114 to the covering position after completion of printing. Specifically, the controller 130 moves the carriage 23 rightward to move the slidable member 171 to the third position, thereby setting the switching mechanism 170 to the third state (see FIGS. 6A and 7C), and transmitting the driving force of the feeding motor 101 to the cam mechanism 112.

Further, to execute the recordation process, the controller 130 applies a driving voltage to a head IC (not shown) configured to drive the piezo elements provided correspondingly to the nozzles 40, and increases the voltage of the inkjet head 30 (S280). It is noted that the controller 130 keeps applying the driving voltage to the inkjet head during printing, the controller 130 drops the driving voltage to zero by the time when the specific time period has elapsed after completion of printing.

As described above, the controller 130 resets the timer circuit in S250. That is, the controller 130 resets the timer circuit in response to the communication I/F 136 receiving the first data when the cap 114 is located at the spaced position. As a result, since the particular time period has elapsed in the state where the first data for next printing has been received when the cap 114 is located at the spaced position (e.g., immediately after completion of printing), a possibility of the cap 114 moving to the covering position can be lowered. Further, with the above configuration, when the driving voltage is being applied to the inkjet head 39 (e.g., immediately after completion of printing), and when the first data for next printing has been received, a possibility that the driving voltage is dropped to zero as the specific time has elapsed can be lowered.

After resetting of the timer circuit, the controller 130 executes a second determining process to determine the state of the driving force transmission assembly 70 (S260). Specifically, in the second determining process, the controller 130 determines the current position of the slidable member 171. The information regarding the position of the slidable member 171 is stored in the RAM 133. That is, the controller 130 is configured to store information regarding the designated destination of the slidable member 171 every time the controller controls the carriage 23 to move the slidable member 171 in the RAM 133. It is noted that a method of determining the current position of the slidable member 171 needs not be limited to the above-described method. For example, the a sensor may be provided to detect the position of the slidable member 171, and the controller 130 may determine the current position of the slidable member 171 based on a detection signal output by such a sensor.

Further, regarding the second determining process, the method needs not be limited to one to determine the current position of the slidable member 171. For example, the controller 130 stores feeding information in the RAM 133 every time the recordation process is executed. The feed information represents information regarding one of the first feeding roller 25 and the second feeding roller 28 which have been driven, or information regarding one of the first feed tray 20 and the second feed tray 22 on which the fed sheets 12 are supported. The controller 130 determines the states of the driving force transmission assembly 70 based on the feed information stored in the RAM 133. For example, when the information regarding the first feed roller 25 or the first feed tray 20 is stored in the RAM 133 as the feed information, the controller 131 determines that the driving force transmission assembly 70 is in the first state in S260. Alternatively, when the information regarding the second feed roller 28 or the second feed tray 22 is stored in the RAM 133 as the feed information, the controller 131 determines that the driving force transmission assembly 70 is in the second state in S260.

In response to the controller 130 determining the driving force transmission assembly 70 being in the first state (more specifically, when the slidable member 171 being located at the first position) (S260: YES), the controller 130 executes the flushing pre-process as mentioned above (S240). Then, the controller 130 operates in a standby state until the second data is received (S290).

In response to the controller 130 determining the driving force transmission assembly 70 being in the second state (more specifically, the slidable member 171 being located at the second position) (S260: NO), the controller 130 control movement of the carriage 23 to change the state of the driving force transmission assembly 70 from the second state to the first state (S270). Specifically, the controller 130 controls the carriage 23 to move the slidable member 171 to the first position. Thereafter, the controller 130 executes the flushing pre-process as mentioned above (S240). Then, the controller 130 operates in the standby state until the second data is received (S290).

It is noted that, as described above, the slidable member 171 moves from the first position to the second position, from the second position to the third position, and from the third position to the first position. That is, when the slidable member 171 is located at the third position, the controller 130 moves the carriage 23 leftward to move the same away from the lever 177 of the slidable member 171, thereby causing the slidable member 171 to move from the third position to the first position by the urging force of the spring 179. When the slidable member 171 is located at the second position, the controller 130 moves the carriage 23 rightward to push the lever 177, thereby causing the slidable member 171 to move from the second position to the third position. Thereafter, the controller 130 moves the carriage 23 leftward, thereby causing the slidable member 171 to move from the third position to the first position.

Further, the controller 130 applies the driving voltage to the head IC (not shown) which is configured to drive the piezo elements provided correspondingly to the nozzles 40, in parallel with steps S220-S270. With this configuration, the voltage of the head IC of the inkjet head 39 increases.

Thereafter, the controller 130 waits for receipt of top one path amount of the second data from the information processing apparatus 140 (S290: NO). In response to receipt of the top one path amount of the second data (S290: YES), the controller determines the target tray based on the image recordation condition included in the second data (S300).

In response to the target tray indicated by the image recordation condition being the first feed tray 20 (S300: YES), the controller 130 executes the recordation process (S310). In the recordation process, the controller 130 executes the flushing. Specifically, in the recordation process, the controller 130 controls the inkjet head 39 of the carriage 23 located in the flushing area to ejects the ink droplets through respective nozzles 40. It is noted that, when the carriage 23 is not located within the flushing area, the controller 130 firstly moves the carriage 23 within the flushing area, and then causes the inkjet head 39 to eject the ink droplets through the nozzles 40.

Next, the controller 130 controls the feeding motor 101 to feed one of the sheets 12 supported by the first feed tray 20 toward the first conveying passage 65. Then, the controller 130 controls the conveying motor 102 to convey the sheet 12 fed from the first feed tray 20 in the conveying direction 16 with use of the conveyer assembly 54.

It is noted that the flushing operation and the feeding operation of the sheet 12 may be executed in parallel. Next, the controller 130 controls the conveying motor 102, the carriage motor 103 and the inkjet head 30 so that the image corresponding to the second data sequentially transmitted on one-path basis is printed on the sheet 12. With the above configuration, feeding of the sheet 12 corresponding to a line break, and the movement of the carriage 23 for one way and ejection of the ink droplets from the inkjet head 39 are alternately executed, thereby an image being recorded on the sheet 12.

In response to the target tray indicated by the image recordation condition being the second feed tray 22 (S300: NO), the controller 130 controls the carriage 23 to cause the state of the driving force transmission assembly 70 from the first state to the second state (S320). Specifically, the controller 130 controls the carriage 23 to execute a switching process to move the slidable member 171 from the first position to the second position, thereby the destination of the driving force of the feeding motor 101 being the second feeder assembly 34.

Next, the controller 130 executes the recordation process (S310). In the recordation process, the controller 130 controls the feeding motor 101 to feed one of the sheets 12 supported by the second feed tray 22 toward the second conveying passage 66. Next, the controller 130 controls the conveying motor 102 to convey the sheet 12, which has been fed to the conveying passage 65 through the second conveying passage 66, in the conveying direction 16. Next, the controller 130 record the image on the sheet 12 according to the process as described above.

According to the above-described configuration, when the communication I/F 136 receives the first data when the cap 114 is located at the spaced position (S210: YES, S220: YES), the controller 130 executes steps S240, S250, S260 and S270. It is noted that, even if the communication I/F 136 receives the first data when the cap 114 is located at the spaced position, the controller 130 does not ignore the received first data. With this configuration, it becomes possible to start the switching process before receipt of the second data. Further, since steps S240, S250, S260 and S270 are executed in response to receipt of the first data, which is received earlier than the second data, the state of the driving force transmission assembly 70 can be changed to from the first state (more specifically, the slidable member 171 is located at the first position).

The reason why the state of the driving force transmission assembly 70 is set to the first state in response to receipt of the first data in the above-descried disclosures is as follows. In the first state, the first feeding roller 25 is ready to be rotated, and the sheets 12 in the first feed tray 20 become feedable. The first feed tray 20 is arranged at a higher position with respect to the second feed tray 22, and generally, the most frequently used tray. In other words, the first feeding roller 25 is the most frequently used feeding roller. Therefore, if the driving forth transmission assembly 70 is set to the first state in response to receipt of the first data, feeding of the sheet from the most frequently used first feed tray 20 can be realized relatively earlier.

Further, according to the illustrative embodiment described above, the controller 130 moves the carriage 23 to a position on the left side with respect to the slidable member 171 located at the first position, that is, on the recordation area side with respect to the non-recordation area in S240. That is, the carriage 23 is moved to a position which is closer to a position where the carriage 23 should be located when the image recordation is started. With this configuration, after execution of S240, image recordation on the sheet 12 can be started quickly.

Further, according to the illustrative embodiment described above, in S240, the controller 130 causes the carriage 23 to move to the flushing area. With this configuration, when the flushing is executed before image recordation on the sheet 12, a time period to move the carriage 23 to the flushing area can be omitted, thereby a starting timing of the flushing can be quickened.

Furthermore, according to the illustrative embodiment, in response to the communication I/F 136 receiving the first data when the cap 114 is located at the spaced position (S210: YES, S220: YES), the controller 130 resets the timer circuit (S250). With this configuration, when the cap 114 is to be remained at the spaced position, a possibility the cap 114 is inadvertently moved to the covering position can be lowered. Further, when the driving voltage applied to the inkjet head 39 is to be maintained, a possibility that the driving voltage is inadvertently dropped can be lowered.

<First Modification>

The above-described illustrative embodiment may be modified such that the controller 130 determines presence/absence of the sheets 12 supported by the first feed tray 20 and executes a process based on the determination when a process regarding the image recordation is executed.

Hereinafter, referring to a flowchart shown in FIG. 10, a process executed by the controller 130 to record an image on the sheet 12 according to a first modification of the illustrative embodiment will be described.

It is noted that the process shown in FIG. 10 is almost the same as that shown in FIG. 9, only parts thereof being different. Therefore, in FIG. 10, steps same as those in FIG. 9 are assigned with the same step numbers, while steps different from those in FIG. 9 being assigned with step numbers (S410-S430) which are not used in FIG. 9. In the following description, steps different from those in FIG. 9 will be described, when steps the same as those in FIG. 9 will not be described for brevity.

In FIG. 10, the controller 130 executes a presence/absence determining process to determine whether there are the sheets 12 in the first feed tray 20 (S410) after resetting of the timer circuit (S250) and before determination of the state of the driving force transmission assembly 70 (S260).

In the first modification, the controller 130 determines presence/absence of the sheets 12 in the first feed tray 20 based on the signal output by the detector 123.

For example, it is assumed that the controller 130 output an instruction to feed the sheet 12 in the first feed tray 20 toward the first conveying passage 65, but the high level signal has not been output from the detector 123 even if a particular time has elapsed since the instruction was issued. In such a case, the controller 130 determines that there is no sheet 12 in the first feed tray 20. Then, the controller 130 stores absence information indicating the there is no sheet 12 in the first feed tray 20 in the RAM 133. If the detector 123 detects the sheet 12 within the particular period after the instruction, the controller 130 determines that the first tray 20 supports the sheet 12. In this case, the controller 130 does not store the absence information in the RAM 133. It is noted that, if the RAM 133 initially stores the absence information, the controller 130 deletes the same.

Then, in S410 after receipt of the print instruction from the information processing apparatus 140, the controller 130 refers to the RAM 133. In response to the RAM 133 storing the absence information, the controller 130 determines that there is no sheet 12 in the first feed tray 20. Further, in response to the RAM 133 not storing the absence information, the controller 130 determines that the first feed tray 20 accommodates the sheets 12.

It is noted that the determination of presence/absence of the sheets 12 in the first feed tray 20 needs not be limited to the above-described method. For example, sensors capable of detecting the sheets 12 in the first feed tray 20 and the second feed tray 22 may be provided. Then, the controller 130 determines the presence/absence of the sheets 12 in each of the first feed tray 20 and the second feed tray 22 based on output signals of such sensors.

In response to determination that there are sheets 12 in the first feed tray 20 (S410: YES), the controller 130 executes steps S260 onwards as in the illustrative embodiment above.

On the other hand, in response to determination that there are no sheets 12 in the first feed tray 20 (S410: NO), the controller 130 executes the second determining process to determine the state of the driving force transmission assembly 70 (S420). Specifically, the controller 130 determines whether the slidable member 171 is located at the second position. It is noted that this determination is similar to than in S260.

In response to determination that the state of the driving force transmission assembly 70 is the second state (specifically, the slidable member 171 is located at the second position) (S420: YES), the controller 130 executes the flushing pre-process (S240). Then, the controller 130 waits for receipt of the second data (S290).

In response to determination that the state of the driving force transmission assembly 70 is the first state (specifically, the slidable member 171 is not located at the second position) (S420: NO), the controller 130 controls the carriage 23 to execute the switching process to change the state of the driving force transmission assembly 70 from the first state to the second state (S430). Specifically, the controller 130 controls the carriage 23 to move the slidable member 171 to the second position. Next, the controller 130 executes the flushing process (S240). Thereafter, the controller 130 waits for receipt of the second data (S290).

According to the first modification, when there are no sheets 12 in the first feed tray 20 (S410: NO), the controller 130 executes S420 and S430, thereby setting state of the driving force transmission assembly 70 to the second state. Specifically, the controller 130 controls the carriage 23 to move the slidable member 171 to the second position at which the second feeder assembly 34 corresponding to the second feed tray 22 serves as the destination of the driving force. Further, when there are sheets 12 in the first feed tray 20 (S410: YES), the controller 130 executes S260 and S270 so that the state of the driving force transmission assembly 70 is set to be the first state. Specifically, the controller 130 controls the carriage 23 to move the slidable member 171 to the first position at which the first feed assembly 15, which corresponds to the first feed tray 20, is set to be the destination of the driving force.

<Second Modification>

The controller 130 may be configured to determine the type of the sheets 12 in the first feed tray 20 and the type of the sheets 12 in the second feed tray 22 are the same or not, and execute a process depending on the result of the determination in the process regarding the image formation.

Hereinafter, referring to the flowchart shown in FIG. 11, a process executed by the controller 130, regarding printing of the image on the sheets 12 will be described.

It is noted that the process shown in FIG. 11 is almost the same as that shown in FIG. 9, only parts thereof being different. Therefore, in FIG. 11, steps same as those in FIG. 9 are assigned with the same step numbers, while a step different from that in FIG. 9 being assigned with a different step number (S510) used in FIG. 9. In the following description, steps different from those in FIG. 9 will be described, when steps the same as those in FIG. 9 will not be described for brevity.

In FIG. 11, controller 130 executes a type determining process (S510) after resetting of the timer circuit (S250). The controller 130 executes the type determining process before execution of the second determining process (S260) to determine the state of the driving force transmission assembly 70. It is noted that the type determining process is a process to determine whether the type information of the sheet 12 in the first feed tray 20 and the type information of the sheet 12 in the second feed tray 22 are identical or not (S510).

The type information of the sheet 12 may include, for example, the size of the sheet 12. It is noted that the type information of the sheet 12 needs not be limited to the information regarding the size of the sheet 12. For example, the type information of the sheet 12 may include information regarding material (e.g., normal type, glossy type, and etc.). It is also noted that the type information of the sheet 12 may include both the information on the size of the sheet 12 and the material of the sheet 12. In such a case, when the type information of the sheets 12 is identical, both the size and the material of two sheets 12 are the same.

Each piece of the type information of the sheets 12 (e.g., the information regarding the size of the sheets 12) in the first feed tray 20 and the second feed tray 22 is stored in the RAM 133 or the EEPROM 134. The user can designate the size of the sheet 12 by operating the input I/F 143 of the information processing apparatus 140 or the operation panel 17 of the MFP 10. Then, the controller 130 stores the information regarding the designated size of the sheet 12 in the RAM 133 or the EEPROM 134.

It is noted that designation of the size of the sheet 12 needs not be done through the input I/F 143 or the operation panel 17. For example, a sensor configured to output different signals based on the types of the sheet 12 may be provided to each of the first feed tray 20 and the second feed tray 22, thereby the size of the sheet 12 being determined based on the signal output by such a sensor. That is, the controller 130 receives the output signal of the sensor, and information regarding the size of the sheet 12 is stored in the RAM 133 or the EEPROM 134 based on the received signal.

In response to determination that the type information of the sheets 12 in the first feed tray 20 and the type information of the sheets 12 in the second feed tray 22 are identical in the type determining process (S510: YES), the controller 130 executes the flushing pre-process (S240). Thereafter, the controller 130 waits for receipt of the second data (S290).

In response to determination, in the type determining process, that the type information of the sheets 12 in the first feed tray 20 and the type information of the sheets 12 in the second feed tray 22 are not identical (S510: NO), the controller 130 executes the second determining process (S260), or the second determining process and the switching process (S260 and S270). Then, the controller 130 waits for receipt of the second information.

According to the second modification, when the type information of the sheets 12 in the first feed tray 20 and the type information of the sheets 12 in the second feed tray 22 are identical, the controller 130 maintains the current state of the driving force transmission assembly 70. Therefore, unnecessary movement of the slidable member 171 can be avoided.

<Other Modifications>

According to the above-described embodiment, the controller 130 moves the carriage 23 to the flushing area. Such a configuration may be modified to another configuration. For example, the controller 130 the controller 130 may not move the carriage 23 to the flushing area, but may move to the recordation area.

According to the above configuration, the slidable member 171 is located at the first position in S260 or S270, and the carriage 23 moves to the recordation area which is closer to the non-recordation area than the flushing area is. In such a configuration, when it becomes necessary to drive the second feeder assembly 34 based on the image recordation condition in the recordation process (S310), the carriage 23 can be moved to the non-recordation area quickly, thereby changing the position of the slidable member 171 from the first position to the second position.

Further, according to the above configuration, the carriage 23 is moved to the recordation area which is closer to the flushing area than the non-recordation area is. Accordingly, when flushing is performed before image formation on the sheet 12, it is possible to move the carriage 23 to the flushing area quickly. As a result, a timing at which flushing is started can be made earlier.

According to the above-described configuration, when the cap 114 is located at the spaced position (S220: YES), the controller 130 rests the timer circuit (S250). It is noted that the controller 130 may be configured to extend the preset threshold time period instead of resetting the timer circuit. For example, when the preset threshold time period has been set to five seconds, in response to the cap 114 being located at the space position in S230, the controller 130 may extend the preset threshold time period to ten seconds.

In the above-described embodiment, the MFP 10 is provided with two feed trays (i.e., the first feed tray 20 and the second feed tray 22). It is noted that the MFP 10 may be provided with three or more feed trays. In such a case, the feeder assembly may be provided to each of the feed tray. Further, in such a case, there may be provided four or more driven gears in accordance with the number of the feed trays. Further, the slidable member 171 may be configured to be located at positions other than the above-described positions (i.e., the first position, the second position and the third position) in addition to the same.

What is claimed is:

1. An inkjet printing apparatus, comprising:

an inkjet head having nozzles;

a carriage mounting the inkjet head and movable within a recordation area and a non-recordation area different from the recordation area, the recordation area being an area at which the inkjet head faces a sheet passed through a conveying passage;

a motor;

multiple feeder assemblies respectively configured to feed the sheet toward the conveying passage as a driving force is transmitted from the motor;

a driving force transmission assembly configured to switch a state thereof between a first state and a second state in accordance with movement of the carriage located within the non-recordation area, the first state being a state in which the driving force transmission assembly connects the motor and a particular feeder assembly among the multiple feeder assemblies, the second state being a state in which the driving force transmission assembly connects the motor and a feeder assembly other than the particular feeder assembly among the multiple feeder assemblies;

a cap positioned on the non-recordation area and movable between a covering position and a spaced position, the covering position being a position at which the cap covers the nozzles of the inkjet head, the spaced position being a position at which the cap does not cover the nozzles;

a communication interface; and a controller, wherein the controller is configured to:

in response to elapse of a threshold time after the cap is at the spaced position, move the cap located at the spaced position to the covering position at which the cap covers the nozzles of the inkjet head;

in response to receiving first data while the cap is at the spaced position, maintain the cap at the spaced position even if the threshold time has elapsed after the cap is at the spaced position, and determine whether the state of the driving force transmission assembly is the first state, the first data including an instruction to move the cap from the covering position to the spaced position and associated with a print instruction;

in response to determination that the state of the driving force transmission assembly is not the first state, switch the state of the driving force transmission assembly to the first state by moving the carriage to the non-recordation area; and in response to determination that the driving force transmission assembly being in the first state or after switching of the state of the driving force transmission assembly to the first state is started, receive second data through the communication interface from the information processing apparatus, the second data including image recordation condition and associated with the print instruction.

2. The inkjet printing apparatus according to claim 1, wherein the particular feeder assembly comprises:

a tray; and a sensor configured to output a signal representing absence/presence of the sheets on the tray, wherein the controller is further configured to:

in response to determination that the cap is located at the space position, determine absence/presence of the sheets on a particular tray included in the particular feeder assembly based on the signal output by the sensor;

in response to determination that the sheets are absent in the particular tray and determination that the state of the transmission assembly is the first state, switch the state of the driving force transmission assembly from the first state to the second state by moving the carriage to the non-recordation area; and in response to determination that the sheets are absence on the particular tray and determination that the state of the transmission assembly is the second state, receive the second data.

3. The inkjet printing apparatus according to claim 2, wherein the controller is further configured to:

in response to determination that the sheets are present on the particular tray and the state of the transmission assembly is the second state, switch the state of the driving force transmission assembly from the second state to the first state by moving the carriage to the non-recordation area; and in response to determination that the sheets are present on the particular tray and the state of the transmission assembly is the first state, receive the second data.

4. The inkjet printing apparatus according to claim 1, further comprising:

a first tray for the particular feeder assembly;

a second tray for another feeder assembly which is different from the particular feeder assembly; and a memory configured to store sheet type information representing sheet types of the sheets in the first tray and in the second tray, wherein the controller is further configured to:

in response to determination that the cap is located at the spaced position, determine the sheet type of the sheets in the first tray and the sheet type of the sheet in the second tray by referring to the memory;

in response to determination that the sheet type of the sheets in the first tray and the sheet type of the sheets in the second tray are different, determine the state of the driving force transmission assembly; and in response to determination that the sheet type of the sheets in the first tray and the sheet type of the sheets in the second tray are identical, receive the second data.

5. The inkjet printing apparatus according to claim 1, wherein the controller is further configured to, after switching the state of the driving force transmission assembly from the second state to the first state, move the carriage such that the inkjet head face a flushing area.

6. The inkjet printing apparatus according to claim 5, wherein the controller is further configured to, in response to determination that the state of the driving force transmission assembly is the first state, move the carriage such that the inkjet head face the flushing area.

7. The inkjet printing apparatus according to claim 1, wherein the controller is further configured to:

count an elapsed time since completion of printing of an image on the sheet based on the second data;

in response to the elapsed time reaching a threshold time, move the carriage to the non-recordation area and the cap located at the spaced position to the covering position; and in response to determination that the cap is located at the spaced position, one of reset the elapsed time and extend the threshold time by a particular time period.

8. The inkjet printing apparatus according to claim 1, wherein the controller is further configured to:

count an elapsed time since completion of printing of an image on the sheet based on the second data;

in response to the elapsed time reaching a threshold time, drop a driving voltage applied to the inkjet head to zero; and in response to determination that the cap is located at the spaced position, one of reset the elapsed time and extend the threshold time by a particular time period.

9. The inkjet printing apparatus according to claim 1, wherein the controller is further configured to, in response to determination that the cap is located at the covering position, switch the state of the driving force transmission assembly to the first state.

10. A method of controlling an inkjet printing apparatus, comprising:

in response to elapse of a threshold time after a cap is at a spaced position which is spaced from an inkjet head mounted on a carriage, moving the cap located at the spaced position to the covering position at which the cap covers nozzles of the inkjet head;

in response to receiving first data while the cap is at the spaced position, maintaining the cap at the spaced position even if the threshold time has elapsed after the cap is at the spaced position, and determining whether a state of a driving force transmission assembly is a first state in which a transmission assembly connects a motor and a particular feeder assembly among the multiple feeder assemblies, the first data including an instruction to move the cap from the covering position to the spaced position and associated with a print instruction;

in response to determination that the cap is located at the spaced position, determining whether the state of the driving force transmission assembly is the first state or a second state in which the transmission assembly connects the motor and a feeder assembly other than the particular feeder assembly among the multiple feeder assemblies;

in response to determination that the state of the driving force transmission assembly is not the first state, switching the state of the driving force transmission assembly to the first state by moving the carriage to the non-recordation area; and in response to determination that the driving force transmission assembly being in the first state or after switching of the state of the driving force transmission assembly to the first state is started, receiving second data through the communication interface from the information processing apparatus, the second data including image recordation condition and associated with the print instruction.

11. The inkjet printing apparatus according to claim 1, wherein the image recordation condition includes data indicating a target feeder assembly, from which the sheet is to be fed based on the print instruction, among the multiple feeder assemblies.

12. The inkjet printing apparatus according to claim 1, wherein the multiple feeder assemblies comprises a first feeder assembly and a second feeder assembly, wherein the image recordation condition includes data indicating a target feeder assembly, from which the sheet is to be fed based on the print instruction, among the first feeder assembly and the second feeder assembly, wherein the controller is further configured to:

in response to receiving the second data including the image recordation condition which includes data indicating the second feeder assembly as the target feeder assembly, before executing image recordation based on the second data, switch the state of the driving force transmission assembly from the first state to the second state by moving the carriage while maintaining the cap at the spaced position.

* * * * *